US007552724B2

(12) United States Patent
Yamauchi

(10) Patent No.: US 7,552,724 B2
(45) Date of Patent: Jun. 30, 2009

(54) MULTI-SPARK IGNITION SYSTEM

(75) Inventor: Yuuki Yamauchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 239 days.

(21) Appl. No.: 11/798,379

(22) Filed: May 14, 2007

(65) Prior Publication Data

US 2007/0267004 A1 Nov. 22, 2007

(30) Foreign Application Priority Data

May 17, 2006 (JP) ..... 2006-137178

(51) Int. Cl.
*F02P 3/045* (2006.01)

(52) U.S. Cl. ..... 123/604; 123/605; 123/606; 123/609; 123/610; 123/629; 123/636; 123/637

(58) Field of Classification Search ..... 123/604, 123/605, 606, 609, 610, 629, 636, 637
See application file for complete search history.

(56) References Cited

U.S. PATENT DOCUMENTS 5,056,496 A 10/1991 Morino et al.
5,309,888 A * 5/1994 Deutsch et al. ..... 123/609
5,513,618 A * 5/1996 Rich et al. ..... 123/598
5,638,798 A * 6/1997 Guido et al. ..... 123/609
6,006,143 A * 12/1999 Bartel et al. ..... 701/1
6,167,875 B1 * 1/2001 French et al. ..... 123/606
6,886,547 B2 * 5/2005 Butler, Jr. ..... 123/606
7,400,965 B2 * 7/2008 Kagleder ..... 701/102
7,404,396 B2 * 7/2008 Toriyama et al. ..... 123/598
2002/0043255 A1 * 4/2002 Kameda et al. ..... 123/606
2003/0164164 A1 * 9/2003 Butler, Jr. ..... 123/606
2003/0168049 A1 * 9/2003 Zarkhin et al. ..... 123/609
2006/0027211 A1 * 2/2006 Naruse et al. ..... 123/406.14
2007/0062501 A1 * 3/2007 Ishida ..... 123/618

* cited by examiner

*Primary Examiner*—Erick Solis
(74) *Attorney, Agent, or Firm*—Nixon & Vanderhye, PC

(57) ABSTRACT

A multi-spark ignition system for an internal combustion engine includes ignition coils each of which is mounted on one of spark plugs of an engine, an energy storing circuit, switching elements that repeatedly discharge electric energy stored by the energy storing circuit into the primary coil of the ignition coils; and a control circuit that controls the energy storing circuit and the switching elements according to consolidated signals each of which includes an energy storing command signal for storing electric energy into the energy storing circuit and a joint energy discharging period command signal for discharging the electric energy by the one of the spark plugs.

18 Claims, 15 Drawing Sheets

IG1
WAVE FORM SHAPE
301
DETECT
501
tr
MASKING
521
m
541
561
tS
DETECT
601
tR
641
621
581
S
Q
R
Q̄
IGt1
IGn
WAVE FORM SHAPE
30n
SYNTHE -SIZER
50n
52(n)
MASKING
n
54n
56n
tS
DETECT
60n
tR
64n
62n
58n
S
Q
R
Q̄
IGtn
SYNTHE -SIZER
42
t-SIGNAL
68
t
DETECT
44
wR
66
wS
38
S
Q
R
Q̄
IGw

MULTI-SPARK IGNITION SYSTEM

CROSS REFERENCE TO RELATED APPLICATION

The present application is based on and claims priority from Japanese Patent Application 2006-137178, filed May 17, 2006, the contents of which are incorporated herein by reference.

BACKGROUND OF THE INVENTION

1. Field of the Invention

The present invention relates to a multi-spark ignition system that includes an ignition coil, an energy storing circuit and a switching member. The switching member is controlled to repeatedly discharge the electric energy stored in the energy storing circuit into the primary coil of the ignition coil, thereby generating multiple ignition sparks at a spark plug that is connected with the secondary coil of the ignition coil.

2. Description of the Related Art

Such a multi-spark ignition system is disclosed in JP-P2811781 or U.S. Pat. No. 5,056,496, which is a counterpart of the former. In the disclosed multi-spark ignition system, both a command signal of energy storing and a command signal of energy discharging period are inputted from an engine control unit (ECU) before the stored electric energy is discharged into the ignition coil so that both the energy storing timing and the energy discharging timing can be controlled according to the engine rotation speed.

However, the multi-spark system and the ECU must be connected by two different signal wires. Accordingly, the number of connectors and other related functions such as a failsafe control increases. That is, such a multi-spark ignition system has to have a complicated and bulky interface.

SUMMARY OF THE INVENTION

Therefore, an object of the invention is to provide a multi-spark ignition system that has a simple and compact connection interface.

According to a feature of the invention, a multi-spark ignition system for an internal combustion engine includes a plurality of ignition coils each of which has a primary coil and a secondary coil, an energy storing circuit for storing electric energy, switching elements for repeatedly discharging electric energy stored by the energy storing circuit into the primary coil of the ignition coils, and control means for controlling the energy storing circuit and the switching means according to the plurality of consolidated signals each of which includes an energy storing command signal and an energy discharging period command signal. By providing the control means, the multi-spark system and the ECU can be connected by a single wire, and the interface circuit can be made simple and compact.

In the above multi-spark ignition system, the consolidated signal includes a first pulse for setting energy storing timing and a second pulse for setting an energy discharging period. The control means makes the duration between the rising edge of the first pulse and the rising edge of the second pulse correspond to the timing of the energy discharging period command signal. The control means may include a latch circuit for latching an inverted signal of the consolidated signal in synchronism with the rising edge thereof to form the energy storing command signal. The control means may also include a circuit for forming the rising edge of the energy discharging period command signal in synchronism with the falling edge of the energy storing command signal and the falling edge of the energy discharging period command signal in synchronism with the falling edge of the second pulse.

In the multi-spark ignition system, the control means preferably includes a masking circuit for forming a masking signal that rises up a first preset time after the rising edge of the consolidated signal and falls down a second preset time after the falling edge of the consolidated signal and forming the rising edge of the energy storing command signal from the rising edge of the consolidated signal that is not masked. The masking circuit may include a series circuit of a first constant current source and a capacitor, a first switching element connected between the first constant current source and the capacitor, a second constant current source connected between the junction of the first constant current source and the capacitor and a ground, a second switching element connected between the second constant current source and the ground, a comparator for comparing voltage of the capacitor with a reference voltage, in which: the first switching element has a control terminal to which the consolidated signal is applied; and second switching element has a control terminal to which the inverted signal of the consolidated signal is applied.

In the above multi-spark ignition system, the control means may include a delay circuit for forming a delay signal the rising edge of which delays from the consolidated signal, and a circuit for forming falling edge of the energy discharging period command signal in synchronism with the falling edge of the consolidated signal. The delay circuit may include a series circuit of a constant current source and a capacitor and a comparator that compares voltage of the junction of the constant current source and the capacitor with a reference level, and the consolidated signal is applied to the junction.

In the above multi-spark ignition system the second pulse includes a plurality of pulses each of which is shorter than the first pulse. The control means may include a filtering circuit for removing those of the second pulses that have a shorter pulse width than a preset value and for an energy discharge period command signal forming circuit that forms the falling edge of the energy discharging period command signal in synchronism with the falling edge of the last of the second pulse. The filtering circuit may include a series circuit of a constant current source and a capacitor and a comparator that compares voltage of the junction of the constant current source and the capacitor with a reference level, and the consolidated signal is applied to the junction. The energy discharge period command signal forming circuit may include a series circuit of a constant current source and a capacitor and a comparator that compares voltage of the junction of the constant current source and the capacitor with a reference level, the inverted signal of the consolidated signal (IG-A) is applied to the junction, and the falling edge of the energy discharging period command signal is formed in synchronism with the rising edge of the output signal of the comparator.

In the above multi-spark ignition system, each of the consolidated signals includes three signal levels. The three signal levels respectively correspond to the rising edge of the energy storing command signal, the falling edge of the energy storing command signal and the falling edge of the energy discharging period command signal. The control means may further include a first comparator that compares the consolidated signal with a first reference level, a second comparator that compares the consolidated signal with a second reference level that is lower than the first reference level, an AND circuit that provides the logical product of the inverted output signal of the first comparator and the output signal of the second comparator, and each of the consolidated signal rises up to the maximum of the signal levels and falls down to the medium of the signal levels and to the minimum of the signal level, in this order. The control means may include a first comparator that compares the consolidated signal with a first reference level, a second comparator that compares the consolidated signal with a second reference level that is higher than the first reference level, an AND circuit that provides the logical product of the output signal of the first comparator and the inverted output signal of the second comparator, and the consolidated signal falls down from the minimum thereof through the medium thereof and rises up to the maximum.

In the above multi-spark ignition system, the control means may form each of the energy storing command signals that corresponds to one of the engine cylinders and a single energy discharging signal based on the consolidated signals.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
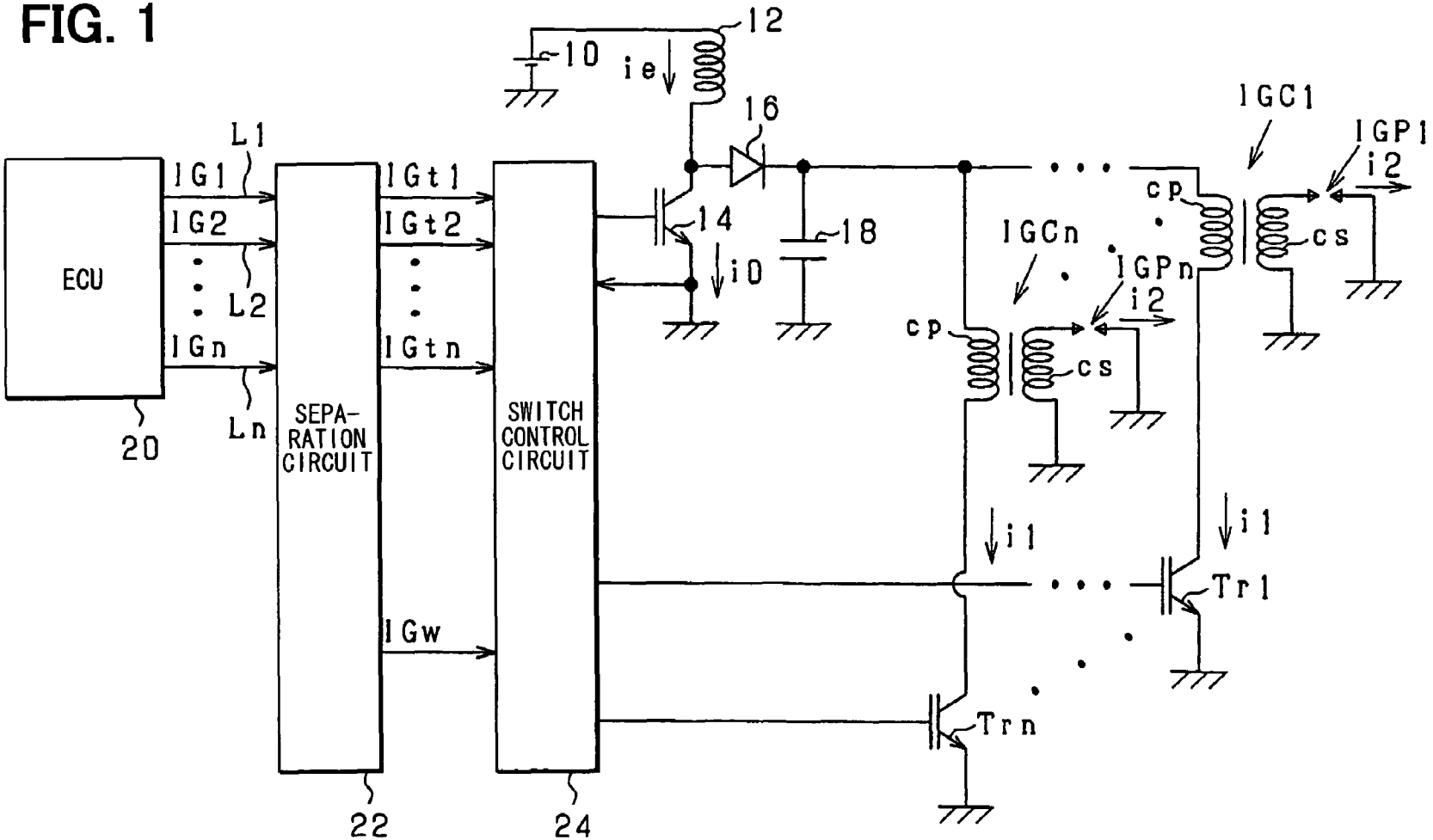
FIG. 1 is a circuit diagram of a multi-spark ignition system according to the first embodiment of the invention.

Some preferred embodiments according to the present invention will be described with reference to the appended drawings.

A multi-spark ignition system according to the first embodiment of the invention will be described with reference to FIGS. 1-5.

The multi-spark ignition system includes a battery 10, a energy storing coil 12, a switching element 14, a diode 16, a capacitor 18, an engine control unit (hereinafter referred to as ECU) 20, a separation circuit 22, a switch control circuit 24, a plurality of ignition coils IGC1-IGCn, a plurality of switching elements Tr1-Trn, etc.

The energy storing coil 12 has one end connected with the battery 10 and the other end connected to a ground via the switching element 14 and to one end of the capacitor 18 via the diode 16. The diode 16 is connected so as to allow current flowing to the capacitor 18 and to prevent current from flowing back. Each of the ignition coils IGC1-IGCn has a primary coil cp and a secondary coil Cs. The other end of the energy storing coil 12 is also connected with one end of each primary coil cp. The other end of the capacitor 18 is connected with the ground, and the other end of each primary coil cp is connected to the ground via one of the switching elements Tr1-Trn. Each secondary coil Cs is connected with one of a plurality of spark plugs IGP1-IGPn.

The ECU 20 is connected to the separation circuit 22 by a plurality of serial lines L1-Ln and provides the latter with consolidated signals IG1-IGn, each of which controls ignition of one of a plurality of engine cylinders. Each of the consolidated signals IG1-IGn includes one of energy storing command signals IGT1-IGTn and an energy discharging period command signals IGw.

The separation circuit 22 forms the energy storing command signals IGT1-IGTn and the energy storing command signal IGw from the consolidated signals IG1-IGn prior to the discharge by the spark plugs IGP1-IGPn and sends the command signals to the switch control circuit 24 so as to control the switching element 14 and the switch elements Tr1-Trn.

Figure 2:
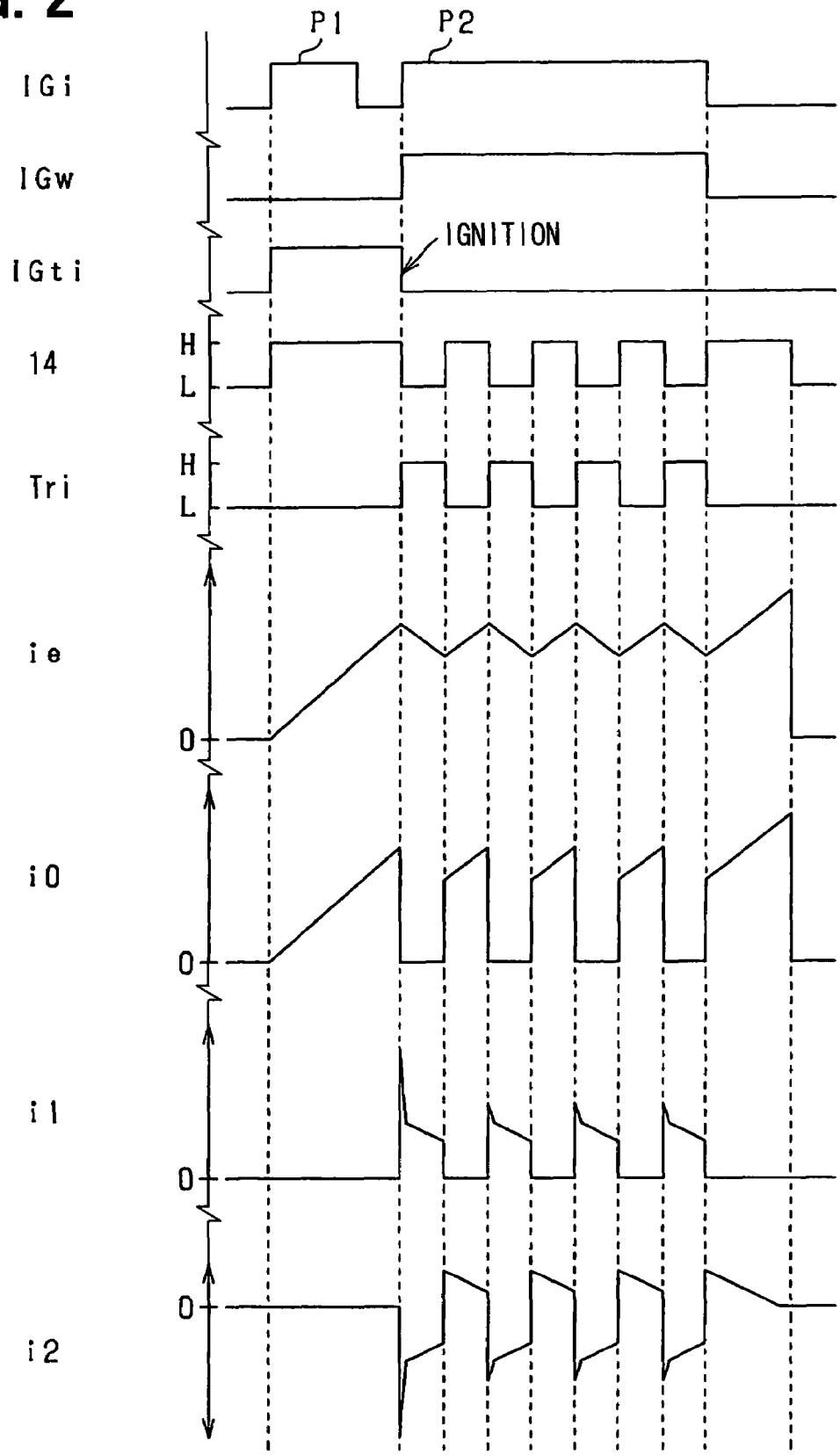
FIG. 2 is a time diagram of the switching operation of the multi-spark ignition system.

The operation of the switch control circuit 24 will be described with reference to FIG. 2.

One of the consolidated signals (i.e. i-th consolidated signal) IGi includes a first pulse P1 and a second pulse P2. The first pulse P1 includes a signal that instructs to store the electric energy into the energy storing coil 12. The second pulse P2 includes a signal that instructs a period to discharge the electric energy by one of the spark plugs (i.e. i-th spark plug) IGPi. The logical level of the i-th energy storing command signal IGti becomes H (i.e. high level) from when the first pulse P1 rises up and stays H until the second pulse P2 rises up. That is, the level H stays between the rising edge of the first pulse P1 and the rising edge of the second pulse P2. The logical level of the energy discharging period command signal stays H as long as the logical level of the second pulse P2 is H.

The switching element 14 is turned on when the level of the energy storing command signal IGti becomes H. Thereafter, current ie flowing through the energy storing coil 12 and current i0 flowing through the switching element 14 gradually increase. Then, the switching element 14 is turned off in synchronism with the falling edge of the energy storing command signal IGti. Thus, the electric energy that is stored in the energy storing coil 12 and the capacitor 18 is discharged into the primary coil cp of the i-th ignition coil IGCi, thereby generating a spark at the i-th spark plugs IGPi. After a predetermined time passed, the switching element Tri is turned off and the switching element 14 is turned on to store electric energy into the energy storing coil 12. Thereafter, the switching element 14 is turned off, and the switching transistor Tri is turned on to discharge the electric energy from the energy storing coil 14 into the primary coil cp. Thereafter, the switching element 14 and the switching element Tri alternately and repeatedly turn on and off to store and discharge the electric energy until the energy discharging period command signal IGw falls down. When the energy discharging period command signal IGw falls down, the switching element Tri turns off, while the switching element 14 is turned on to charge the capacitor 18. Thereafter, the switching element 14 is also turned off.

Incidentally, the switching control circuit 24 that controls the switching elements 14 and Tr1-Trn is a common circuit such as disclosed in U.S. Pat. No. 5,056,496. In this case, a cylinder discriminating signal that indicates which one of the engine cylinders is to be selected is formed according to the energy storing command signal IGti. That is, when the energy storing command signal IGti for i-th cylinder is formed, the i-th switching elements Tri is turned on in synchronism with the falling edge of the energy storing command signal IGti.

Figure 3:
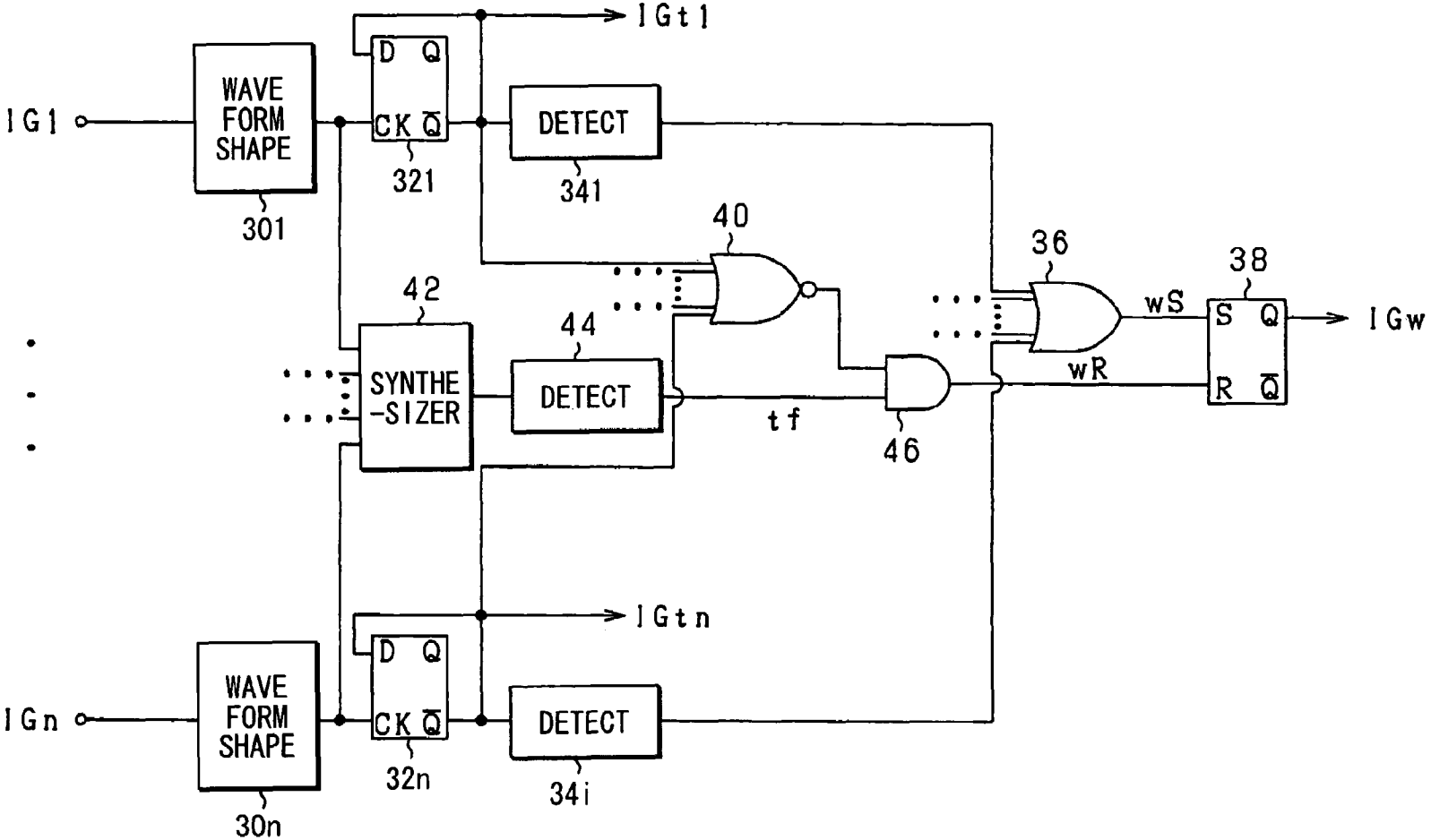
FIG. 3 is a circuit diagram of a separation circuit of the multi-spark ignition system.

As shown in FIG. 3, the separation circuit 22 includes wave-form shaping circuits 301-30*n*, D flip-flop circuits 321-32*n*, falling edge detecting circuits 341-34*n*, an OR circuit 36, a RS flip-flop circuit 38, a NOR circuit 40, a signal synthesizing circuit 42, a falling edge detecting circuit 44, an AND circuit 46, etc.

Figure 4:
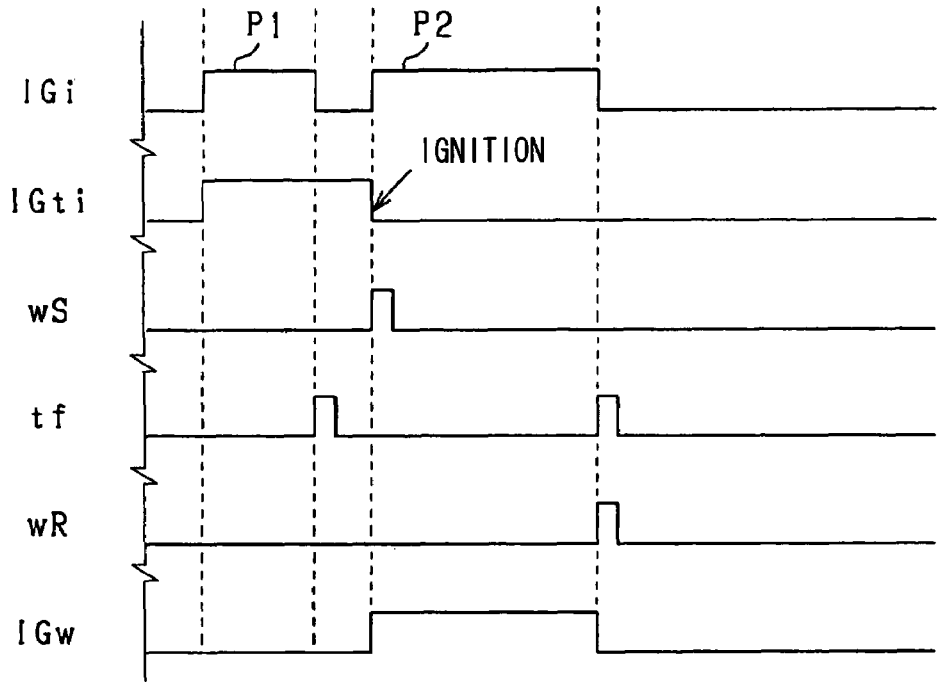
FIG. 4 is a time diagram forming a energy storing command signal and a energy discharging period command signal.

The first wave-form shaping circuit 301 shapes the wave of the first consolidated signal IG1, and the first D flip-flop circuit 321 receives the shaped signal at its clock terminal CK. The inverted output terminal $\overline{Q}$ of the first D flip-flop circuit 321 is connected to the D terminal thereof to provide a feedback circuit. As shown in FIG. 4, each time the i-th wave-shaped consolidated signal IGi rises up, the inverted signal of the signal inputted to the D terminal, which is the first energy storing command signal IGti, is latched. The first energy storing command signal IGt1 is sent to the first falling edge detecting circuit 341, and the i-th energy storing command signal IGti is sent to the i-th falling edge detecting circuit 34*i*. When the i-th falling edge detecting circuit 34*i* detects the falling edge, it provides a one-shot pulse. Thus, a logical sum of as many output signals of the falling edge detecting circuits 341-34*n* as "n" is formed by the OR circuit 36. This logical sum is inputted to the S terminal of the RF flip-flop circuit 38.

On the other hand, the logical sum of the energy storing command signals IGt1-IGtn is provided by the NOR circuit 40. The consolidated signals IG1-IGn are synthesized by the signal synthesizing circuit 42 and, thereafter, inputted to the falling edge detecting circuit 44, which provides a one-shot pulse. Thereafter, the logical product of the output signal of the NOR circuit 40 and the output signal of the falling edge detecting circuit 44 is provided by the AND circuit 46 to be inputted to the RS flip-flop circuit 38. The output signal of the RS flip-flop circuit 38 is the energy discharging period command signal IGw.

The separation circuit 22 forms various signals from the consolidated signals IG1-IGn as shown in FIG. 4. The i-th energy storing command signal IGti becomes H when the first pulse P1 of the i-th consolidated signal IGi rises up and becomes L when the second pulse P2 of the i-th consolidated signal rises up. When the i-th falling edge detecting circuit 34*i* provides a one-shot pulse in synchronism with the falling edge of the i th-energy storing command signal IGt1, the OR circuit 36 provides an output signal wS, so that the energy discharging period command signal IGw becomes H. Thereafter, the second pulse P2 of the i-th consolidated signal IGi falls down to let the falling edge detecting circuit 44 to provide a one-shot pulse wR, so that the energy discharging period command signal IGw becomes L.

Figure 5:
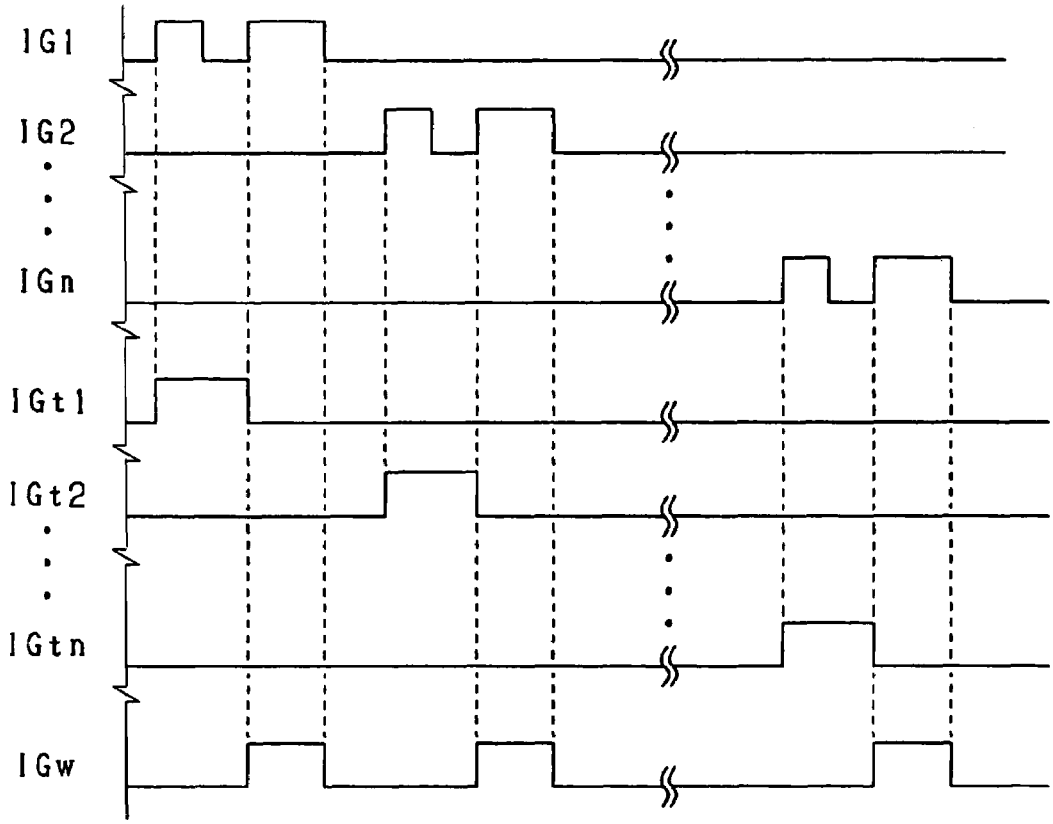
FIG. 5 is a time diagram of input and output signals of the separation circuit.

FIG. 5 shows a time diagram of the consolidated signals IG1-IGn, the energy storing command signals IGt1-IGtn and the energy discharging period command signal IGw.

A multi-spark ignition system according to the second embodiment of the invention will be described with reference to FIG. 6. Incidentally, the same reference numeral as the first embodiment represents the same or substantially the same portion, part or component, hereafter.

Figure 6:
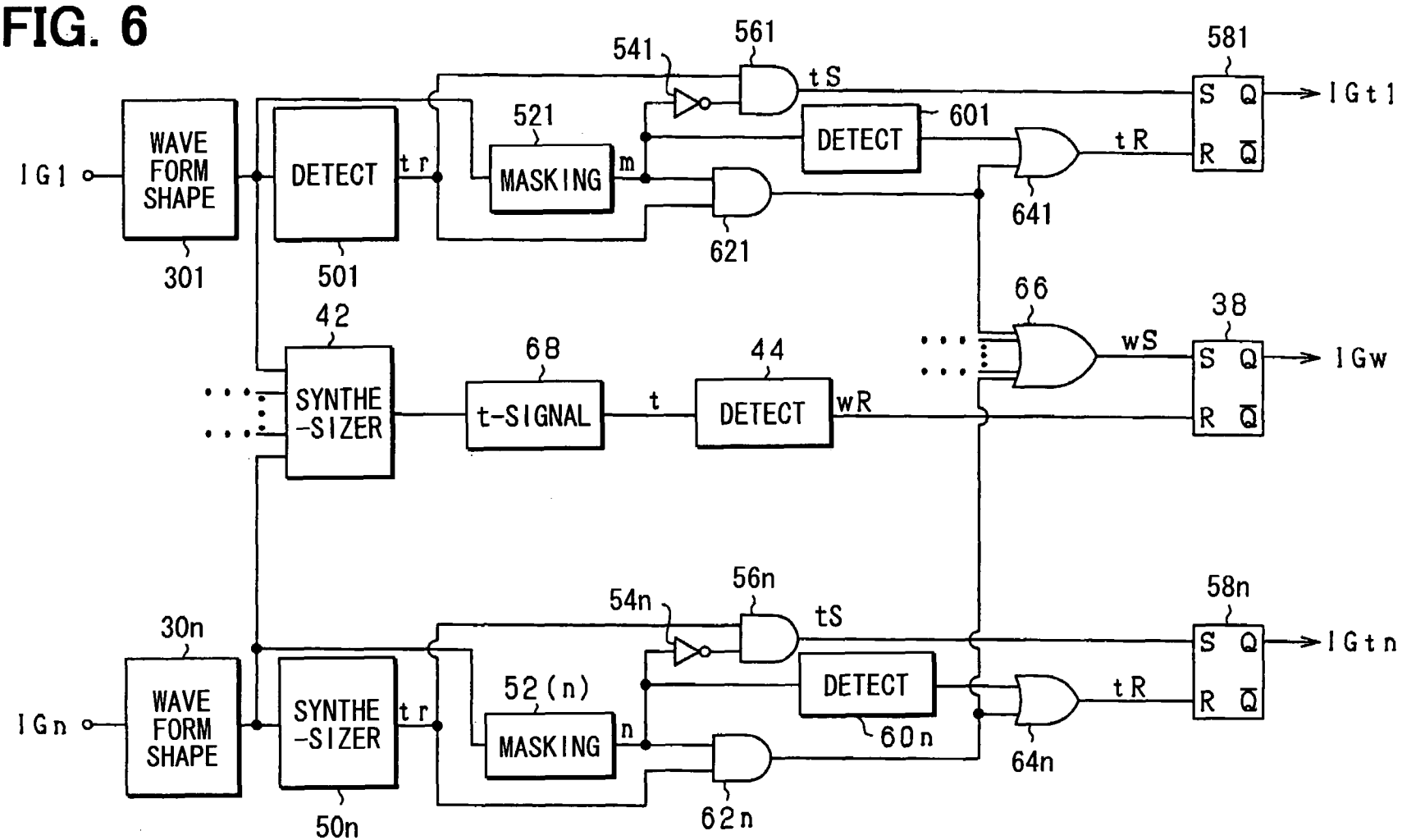
FIG. 6 is a circuit diagram of a separation circuit of the multi-spark ignition system according to the second embodiment of the invention.

As shown in FIG. 6, the separation circuit 22 includes wave-form shaping circuits 301-30*n*, an RS flip-flop circuit 38, a signal synthesizing circuit 42, a falling edge detecting circuit 44, rising edge detecting circuits 501-50*n*, masking signal generating circuits 521-52*n*, a t-signal generating circuit 68, AND circuits 561-56*n*, AND circuits 621-62*n* falling edge detecting circuits 601-60*n*, OR circuits 641-64*n*, an OR circuit 66, RS flip-flop circuits 581-58*n*, etc.

Each wave-form shaping circuit (e.g. 301) shapes the wave of one of the consolidated signals (e.g. IG1). The shaped signal is sent to one of the rising edge detecting circuits (e.g. 501) and one of masking signal generation circuits (e.g. 521). The masking signal generation circuit (e.g. 521) provides a masking signal m that masks a period starting from a delay time after the rising edge of the first pulse P1 of the consolidated signal to the falling edge of the second pulse P2. When the rising edge detecting circuit (e.g. 501) detects the rising edge of the consolidated signal IG1, it provides a one-shot pulse tr.

The AND circuit (e.g. 561) provides a logical product signal tS of the inverted of the masking signal m and the one-shot pulse tr. The logical product signal tS is applied to the S terminal of the flip-flop circuit (e.g. 581). On the other hand, the falling edge detecting circuit (e.g. 601) provides a one-shot pulse signal when it detects the falling edge of the masking signal m. The AND circuit (e.g. 621) provides a logical product signal of the one-shot pulse tr and the masking signal m. The OR circuit (e.g. 641) provides a logical sum signal tR of the output signal of the falling edge detecting circuit (e.g. 601) and the output signal of the AND circuit (e.g. 621). The logical sum signal tR is inputted to the R terminal of the flip-flop circuit (e.g. 581). The output signal of the flip-flop circuit (e.g. 581) is the energy storing command signal (e.g. IGt1).

On the other hand, the OR circuit 66 provides a logical sum signal wS of the AND circuits 621-62*n* to input the signal to the S terminal of the flip-flop 38. The t-signal generating circuit 68 delays the rising edge of output signal of the signal synthesizing circuit 42, which is inputted to the falling edge detecting circuit 44. The output signal wR of the falling edge detecting circuit 44 is applied to the R terminal of the flip-flop circuit 38. The output signal of the flip flop circuit 38 is the energy discharging period command signal IGw.

Figure 7:
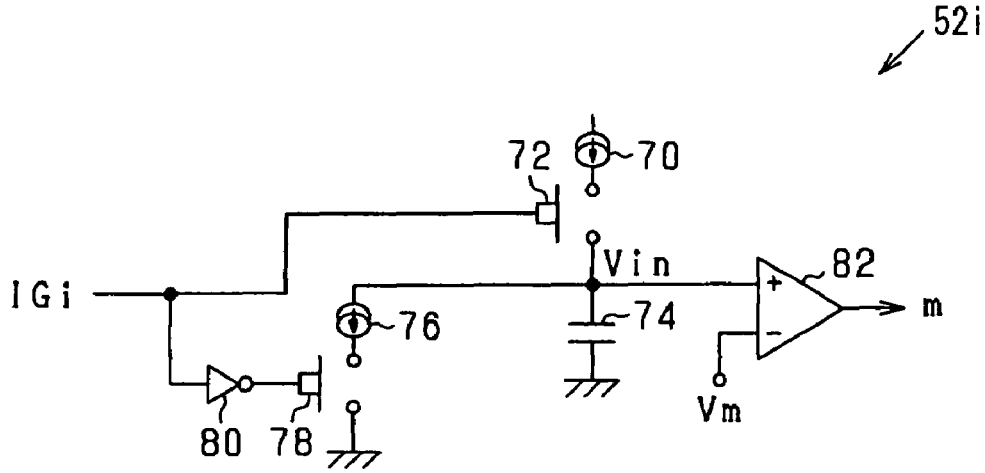
FIG. 7 is circuit diagram of a masking signal generating circuit of the multi-spark ignition system according to the second embodiment of the invention.

The i-th masking signal generating circuit 52*i* of the masking signal generating circuits 521-52*n* is shown in FIG. 7. The masking signal generation circuit 52*i* includes a constant current source 70, a switching element 72, a capacitor 74, a switching element 78, an inverter circuit 80, a comparator 82, etc. Each of the switching elements 72, 78 has a control terminal. The constant current source 70 has one end connected to a battery and the other end connected to one end of the capacitor 74 via the switching element 72. The one end of the capacitor 74 is also connected to one end of the constant current source 76, the other end of which is grounded via the switching element 78. The other end of the capacitor 74 is also grounded. The control terminal of the switching element 72 is a terminal to which the i-th consolidated signal IGi is applied, and the control terminal of the switching element 78 is also a terminal to which an inverted signal of the i-th consolidated signal IGi is applied. The capacitor voltage Vin of the capacitor 74 is applied to the non-inverting terminal of the comparator 82 to be compared with a reference voltage Vm that is applied to the inverting terminal thereof. Incidentally, the reference voltage Vm becomes sufficiently higher than the capacitor voltage Vin when the consolidated signal IGi is L.

Figure 8:
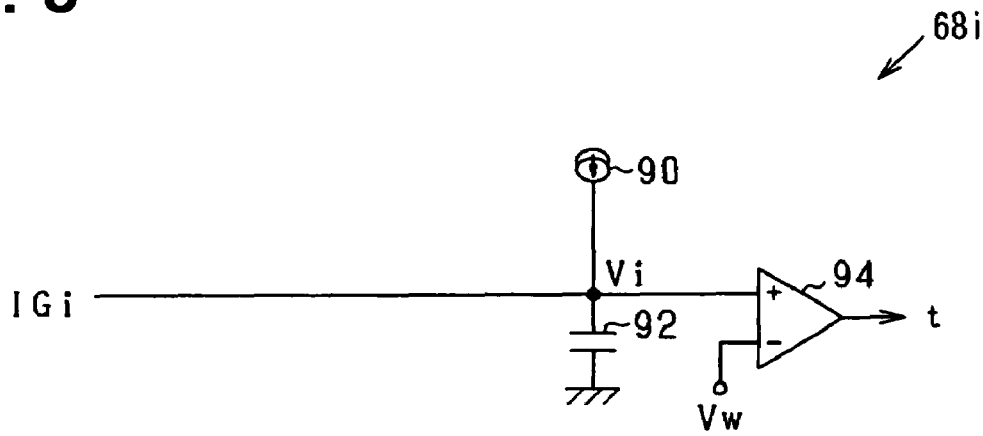
FIG. 8 is a t-signal generating circuit of the multi-spark ignition system according to the second embodiment of the invention.

As shown in FIG. 8, the t-signal generating circuit 68 includes a constant current source 90, a capacitor 92, a comparator 94, etc.

The constant current source 90 has one end connected to the battery and the other end grounded via the capacitor 92. The i-th consolidated signal is applied to junction of the constant current source 90 and the capacitor 92. The capacitor voltage Vi of the capacitor is applied to the non-inverting terminal of the comparator 94 to be compared with a reference voltage Vw that is applied to the inverting terminal thereof. Incidentally, the reference voltage Vw becomes sufficiently higher than the capacitor voltage Vi when the consolidated signal IGi is L.

Figure 9:
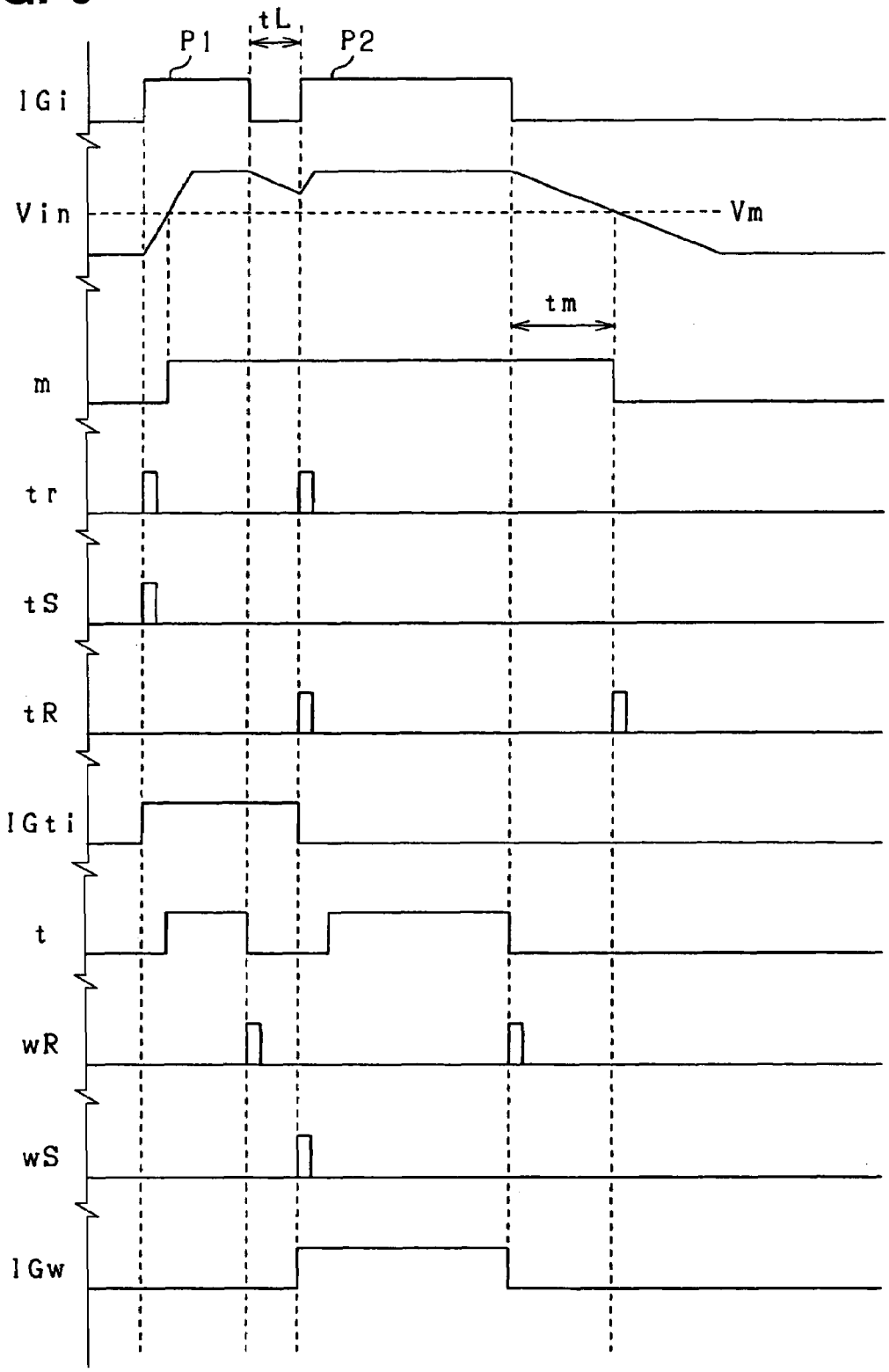
FIG. 9 is a time diagram of generating a energy storing command signal and a energy discharging period command signal of the multi-spark ignition system according to the second embodiment of the invention.

FIG. 9 is a time diagram showing that the energy discharging period command signal IGw is formed from the consolidated signals IG1-IGn (only i-th consolidated signal is shown). When the first pulse PI of the i-th consolidated signal rises up, the capacitor voltage Vin gradually increases. When the capacitor signal Vin becomes higher than the reference voltage Vm, the masking signal m becomes H. On the other hand, when the first pulse P1 rises up, the masking signal has not become H. Therefore, masking by the AND circuit 56*i* is not carried out, and the one-shot pulse tS is provided by the AND circuit 56*i*. Accordingly, the energy storing command signal IGti becomes H.

When, thereafter, the second pulse P2 rises up, the i-th rising edge detecting circuit 50*i* provides a one-shot pulse tr, so that the one-shot signal tR is outputted by the i-th OR circuit 64*i*. Then, the i-th energy storing command signal IGti becomes L. Consequently, the OR circuit 66 outputs the one-shot signal wS, so that the energy discharging period command signal IGw becomes H. When the signal t falls down, the falling edge detecting circuit 44 outputs the one-shot signal wR, and the energy discharging command signal IGw becomes L.

In FIG. 9, the period tL between the first pulse P1 and the second pulse P2 has to be shorter than a period tm that is a time for the capacitor voltage Vin to decrease to be lower than Vm.

Figure 10:
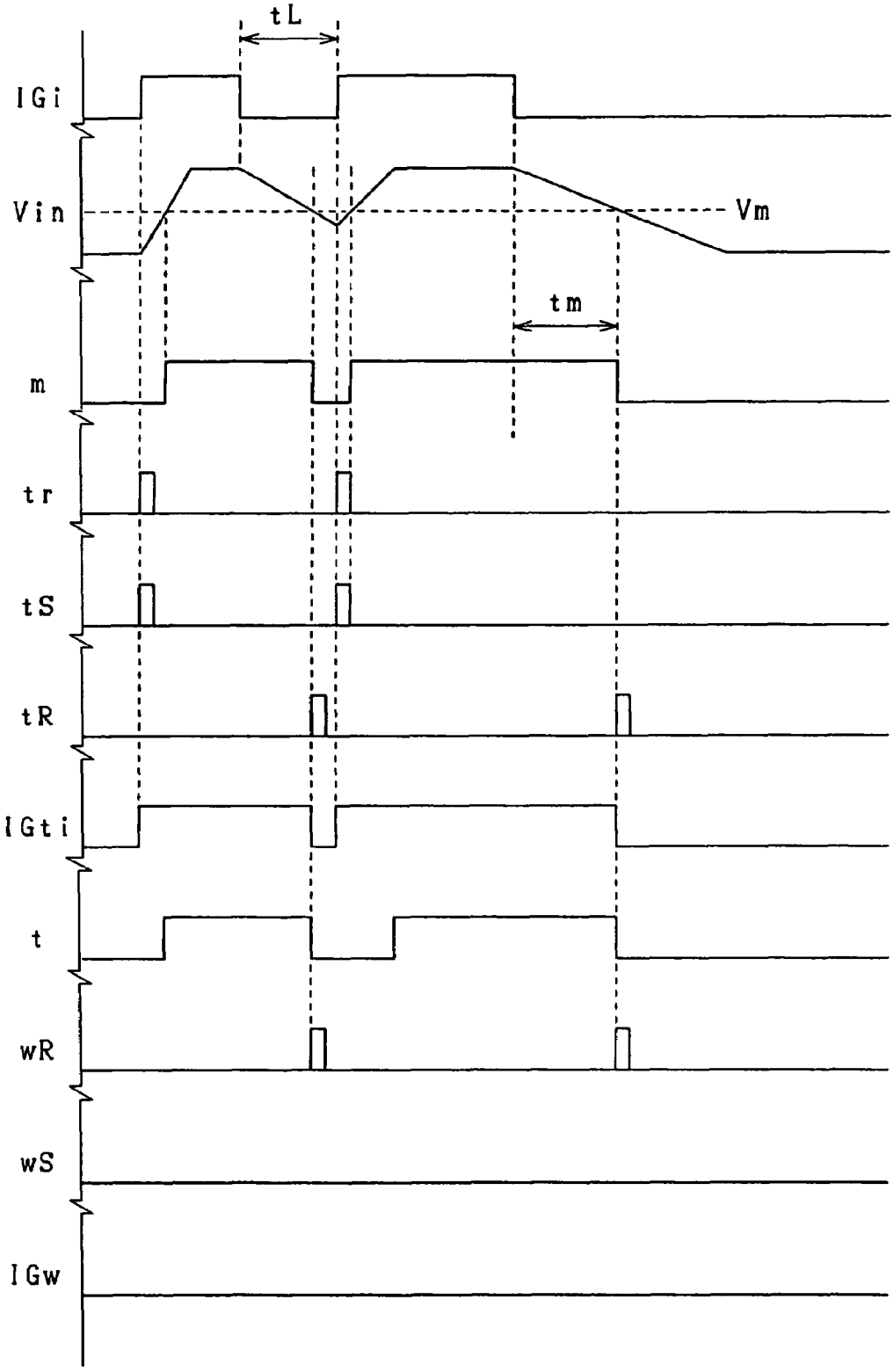
FIG. 10 is a time diagram of irregularly or contingently generating a energy storing command signal and a energy discharging period command signal of the multi-spark ignition system according to the second embodiment of the invention.

Otherwise, it is not possible to provide the energy discharging period command signal IGw, as shown in FIG. 10. In this case, when the masking signal m falls down, the output signal tR of the OR circuit 64*i* becomes H. Therefore, the energy storing command signal IGti becomes L. That is, the overheating of the energy storing coil 12 can be prevented.

A multi-spark ignition system according to the third embodiment of the invention will be described with reference to FIGS. 1 and 11-14.

Figure 11:
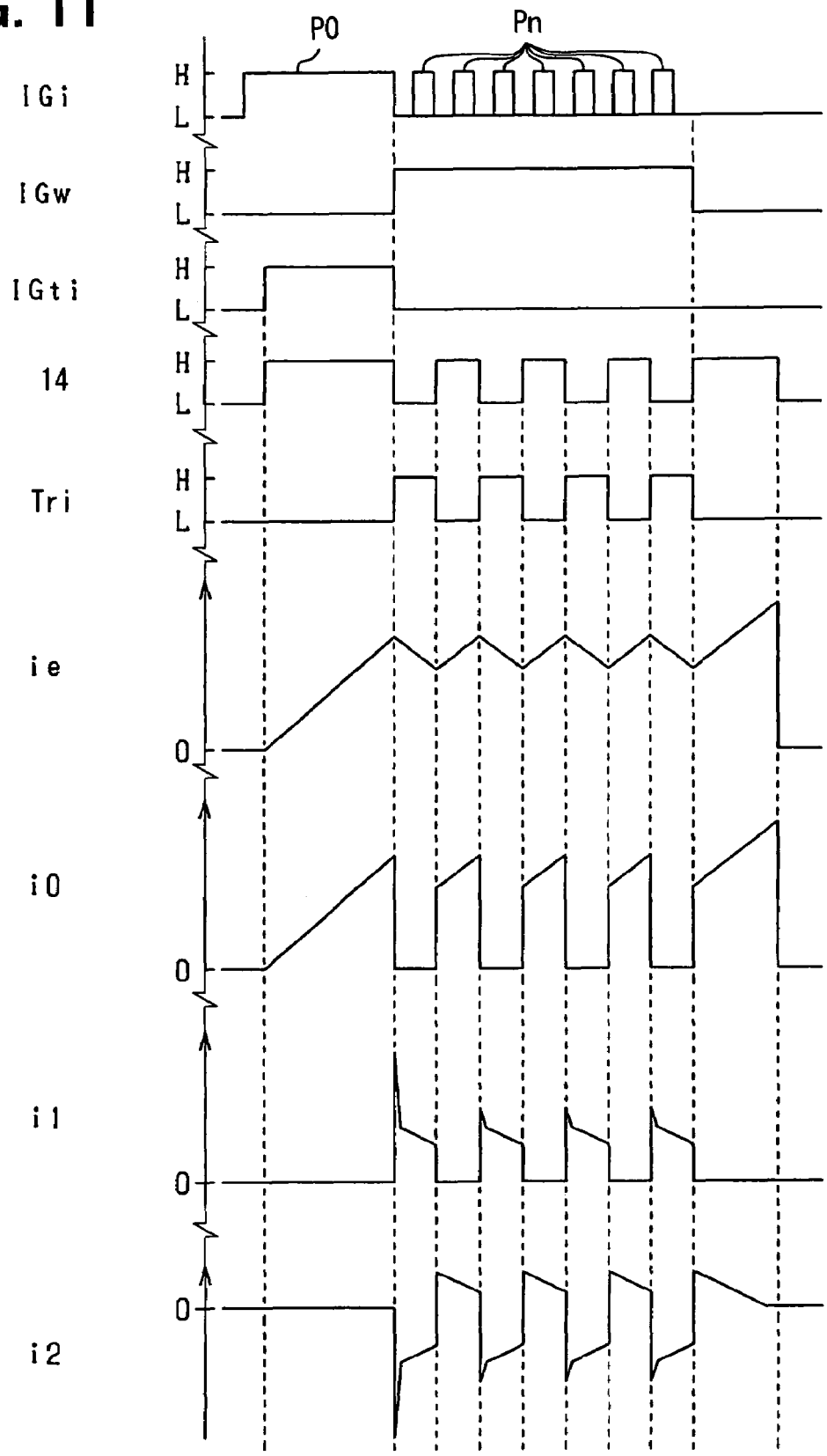
FIG. 11 is a time diagram of generating a energy storing command signal and a energy discharging period command signal of the multi-spark ignition system according to the third embodiment of the invention.

As shown in FIG. 11, the i-th consolidated signal IGi includes a single pulse P0 and seven short pulses Pn. The single pulse P0 includes an energy storing command signal component for the ignition by the i-th spark plug. The seven short pulses Pn include the energy discharging period command signal component for the ignition by the i-th spark plug. The i-th energy storing command signal IGti is formed a preset time after the rising edge of the single pulse P0, and the energy discharging period command signal IGw is formed just when the energy storing command signal falls down. The energy discharging period command signal IGw falls down a preset time after the last short pulse Pn falls down.

Figure 12:
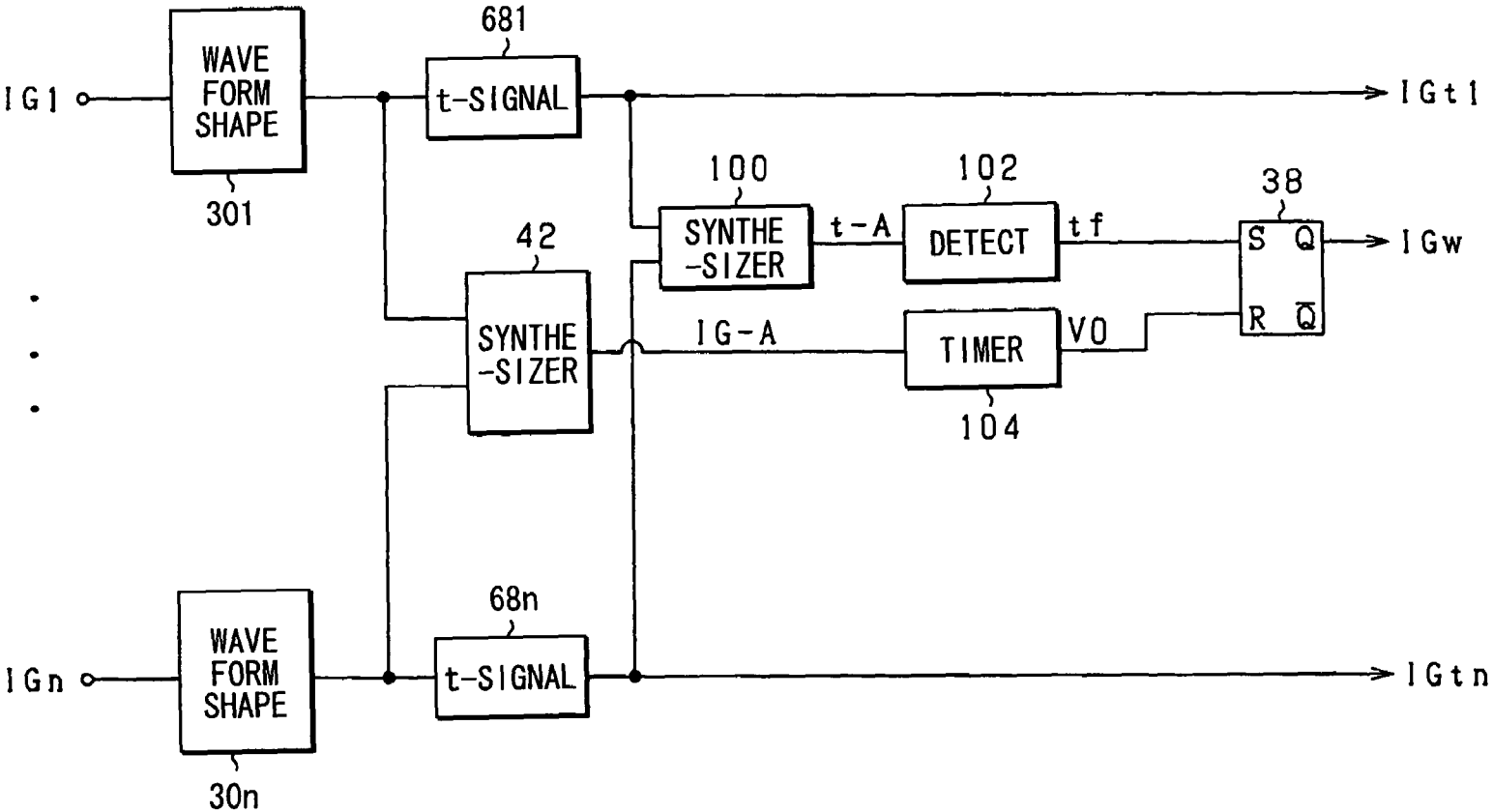
FIG. 12 is a circuit diagram of a separation circuit of the multi-spark ignition system according to the third embodiment of the invention.

As shown in FIG. 12, the separation circuit 22 of the third embodiment includes wave-form shaping circuits 301-30*n*, a t-signal generation circuits 681-68*n*, a RS flip-flop circuit 38, a t-signal synthesizing circuit 100, a falling edge detecting circuit 102, a timer circuit 104, etc. Incidentally, the same reference numeral represents the same or substantially the same as what has been described above.

The first wave-form shaping circuit 301 shapes the wave of the first consolidated signal IG1, and the t-signal generating circuit 681 receives the shaped signal. The signal filtered by the t-signal generating circuit 681 becomes the first energy storing command signal IGt1. Each of the t-signal generating circuit 681-68*n* has the same construction as shown in FIG. 8. Therefore, it is not possible for only the short pulses Pn to make the comparator 94 provide the output signal of H. That is, the short pulses can not pass the t-signal generating circuit (e.g. 681). The rising edge of the single pulse P0 delays after the single pulse P0 passes the t-signal generating circuit.

On the other hand, the output signal of the t-signal generating circuit is logically synthesized by the t-signal synthesizing circuit 100. The t-signal synthesizing circuit 100 provides a logical sum of the signals inputted thereto. The output signal t-A of the t-signal synthesizing circuit 100 is applied to the falling edge detecting circuit 102, which provides a one-shot pulse when it detects a falling edge. The output signal tf of the falling edge detecting circuit 102 is applied to the S terminal of the flip-flop circuit 38. The output signal of the flip-flop circuit 38 is the energy discharging period command signal IGw.

Figure 13A:
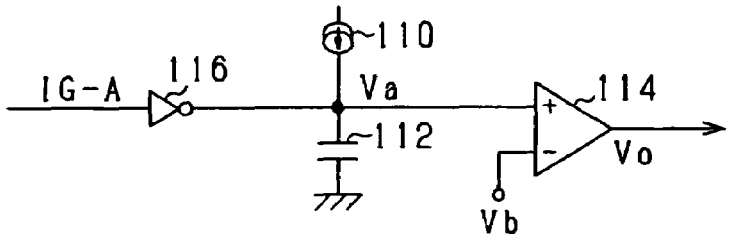
FIG. 13A is a circuit diagram of a timer circuit of the multi-spark ignition system according to the third embodiment of the invention.

The output signal IG-A of the signal synthesizing circuit 42 is sent to the timer circuit 104 whose circuit diagram is shown in FIG. 13A. The timer circuit 104 includes a constant current source 110, a capacitor 112, a comparator 114, an inverter 116, etc. to filter the logically inverted signal of the consolidated signal (e.g. IG1).

The constant current source 110 is connected with one end of the capacitor 112 whose the other end is grounded. The voltage Va of the capacitor 112 is applied to the non-inverting terminal of the comparator 114, whose inverting terminal is applied a reference voltage Vb. The output signal IG-A of the signal synthesizing circuit 42 is applied via the inverter 116 to the junction of the constant current source 110 and the capacitor 112.

With the above arrangement, the signal that is inverted by the inverter 116 is filtered. That is, when the signal IG-A becomes H, the capacitor voltage Va lowers to be lower than the reference voltage Vb. When the signal IG-A becomes L, the capacitor voltage Va increases. Because the signal IG-A becomes H again thereafter, the capacitor voltage Va does not become higher than the reference voltage Vb. That is, the output signal V0 of the comparator 114 does not become H until the short pulses Pn pass through. Then, the output signal of the comparator 114 becomes H a preset time after the last short pulse Pn falls down.

Figure 13B:
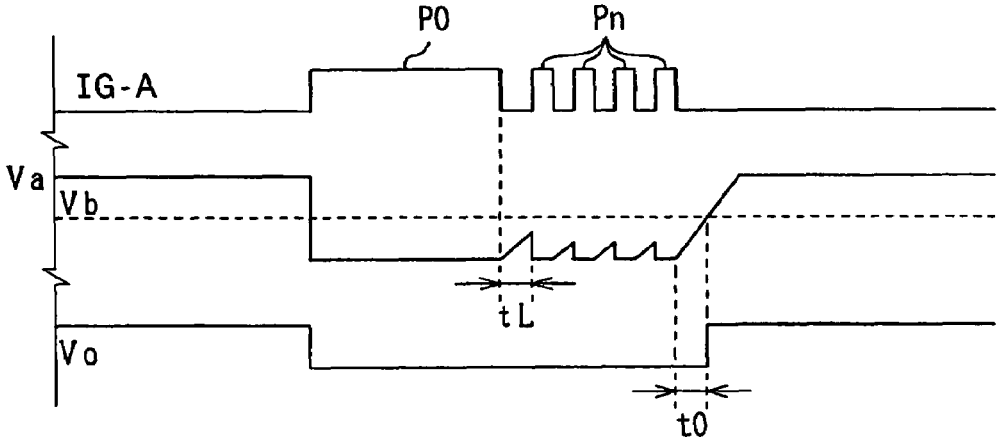
FIG. 13B is a time diagram of the signals shown in FIG. 13A.

Incidentally, the period tL between the single pulse P0 and the short pulses Pn and the period between the short pulses Pb are shorter than a period t0 in which the capacitor voltage Va becomes as high as the reference voltage Vb, as shown in FIG. 13B.

The output signal V0 of the timer circuit 104 is applied to the R terminal of the flip-flop circuit 38. Therefore, the energy discharging period command signal IGw falls down in synchronism with the rising edge of the output signal V0. In other words, the energy discharging period command signal IGw falls down a preset time after the last short pulse Pn falls down, as shown in FIG. 11.

Figure 14:
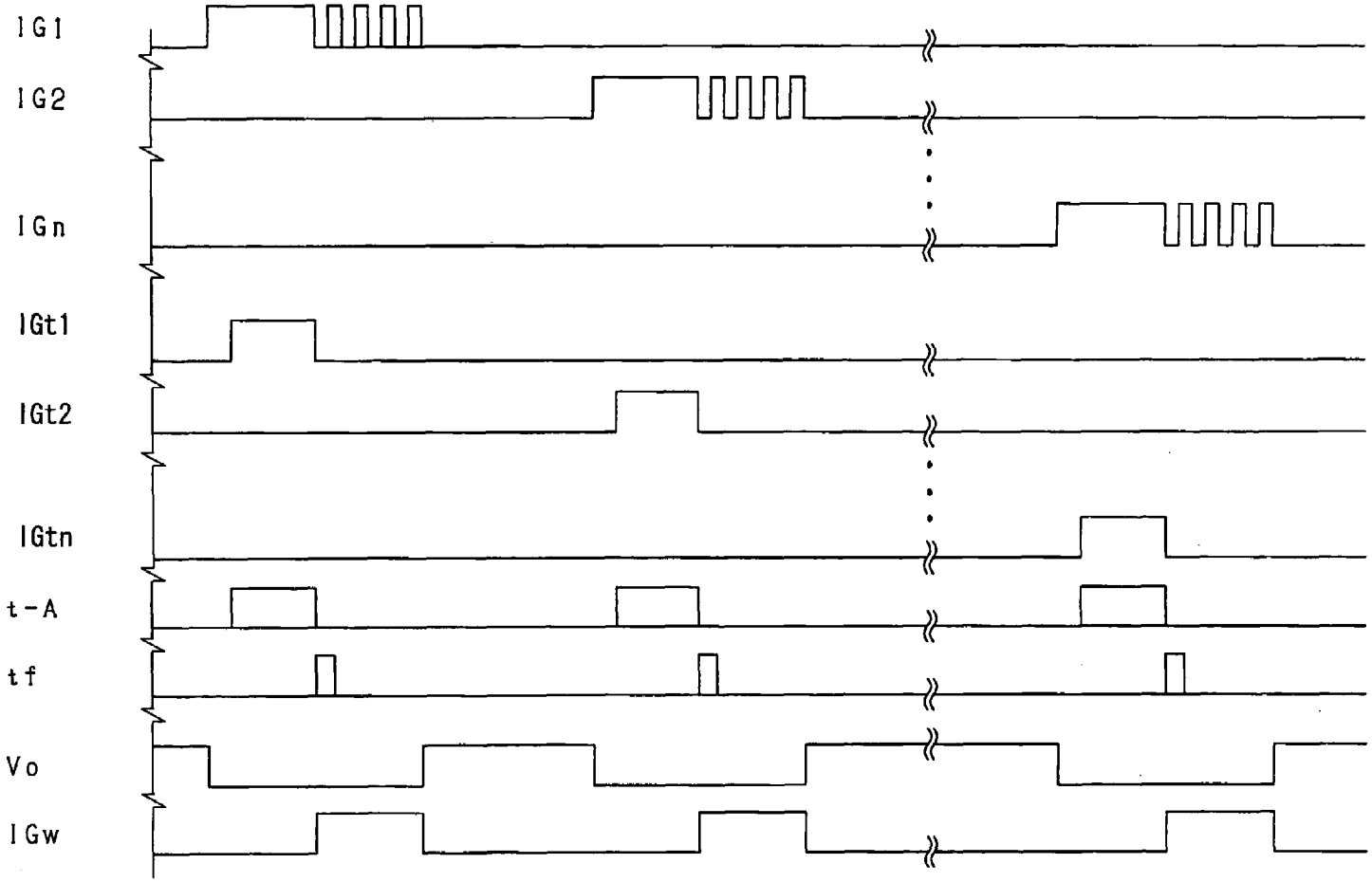
FIG. 14 is a time diagram of input and output signals of the separation circuit according to the third embodiment.

The separation circuit 22 forms the energy discharging period command signal IGw and various other signals from the consolidated signals IG1-IGn as shown in FIG. 14.

A multi-spark ignition system according to the fourth embodiment of the invention will be described with reference to FIGS. 1 and 15-16.

Figure 15:
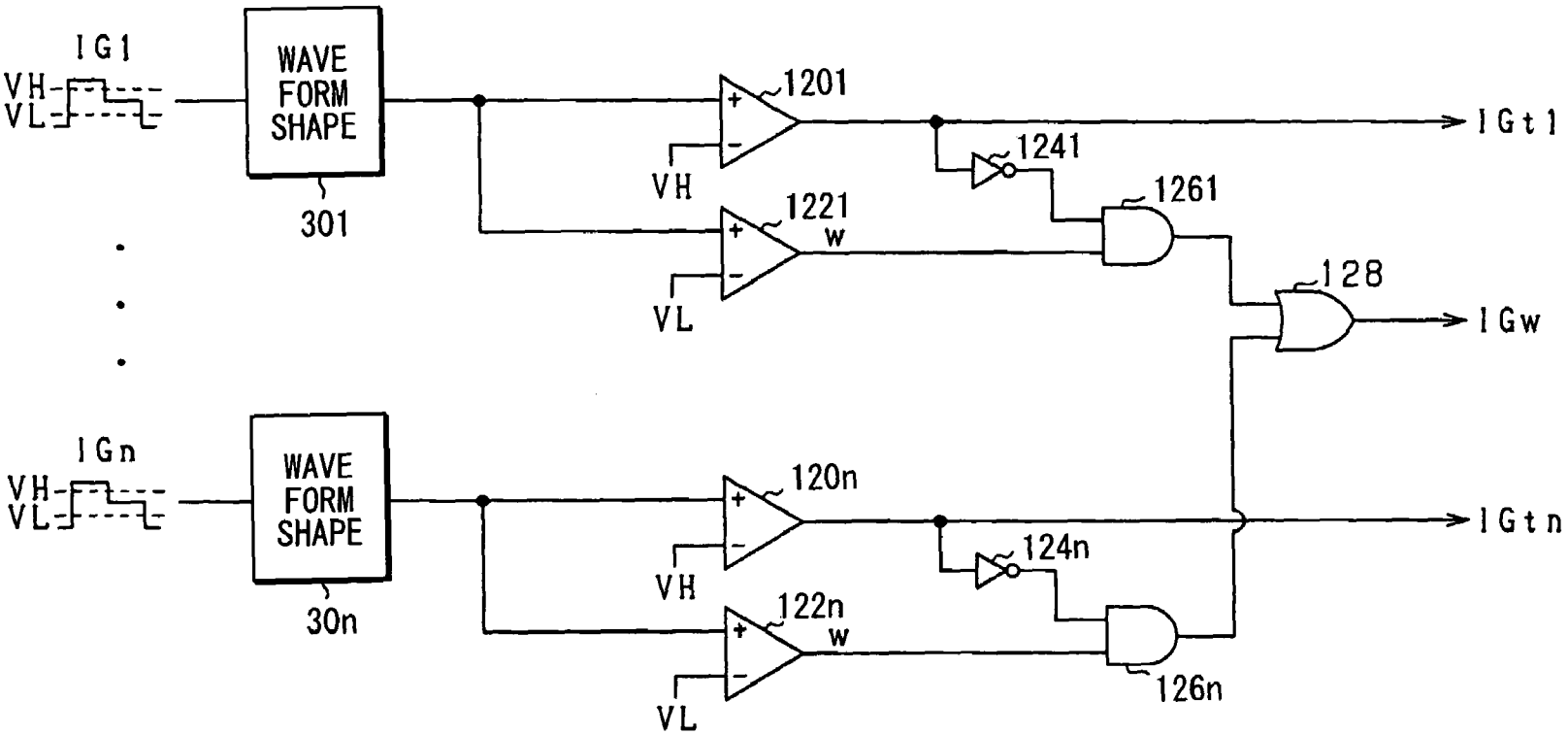
FIG. 15 is a circuit diagram of a separation circuit of the multi-spark ignition system according to the fourth embodiment of the invention.

As shown in FIG. 15, the separation circuit 22 of the fourth embodiment includes wave-form shaping circuits 301-30*n*, higher side comparators 1201-120*n*, lower side comparators 1221-122*n*, inverters 1241-124*n*, AND circuits 1261-126*n*, an OR circuit 128, etc.

Figure 16:
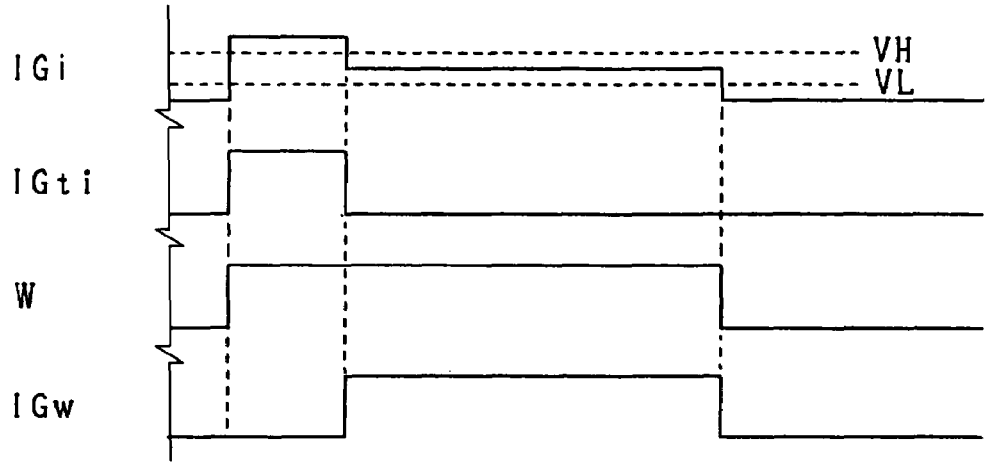
FIG. 16 is a time diagram of generating a energy storing command signal and a energy discharging period command signal of the multi-spark ignition system according to the fourth embodiment of the invention.

As shown in FIG. 16, the consolidated signal has three levels—a maximum level, a medium level and a minimum level. For example, the level of the i-th consolidated signal IGi becomes medium after it becomes maximum. The maximum level of the consolidated signal includes a signal to store electric energy into the energy storing coil 12. The timing of shifting from the medium level to the minimum level of the consolidated signal includes a signal to terminate the energy discharging by the i-th spark plug IGPi. The consolidated signal (e.g. IG1), the wave form of which has been shaped, is inputted to the respective non-inverting terminals of the comparators (e.g. 1201, 1221). The inverting terminal of the higher side comparator (e.g. 1201) is applied a reference voltage VH, and the inverting terminal of the lower side comparator (e.g. 1221) is applied a reference voltage VL that is lower than VH. The output signal of the higher side comparator is the energy storing period command signal (e.g. IGt1).

On the other hand, the AND circuit (e.g. 1261) provides the logical product of the inverted signal of the output signal of the higher side comparator (e.g. 1201) and the output signal of the lower side comparator (e.g. 1221). The OR circuit 128 provides a logical sum of the output signals of the all the AND circuits 1261-126*n*. This is the energy discharging period command signal IGw.

As shown in FIG. 16, when the consolidated signal IGi rises up from the minimum to the maximum that is higher than VH, the output signal IGti (i.e. the i-th energy storing command signal) of the i-th higher side comparator 120*i* becomes H. When the level of the consolidated signal IGi shifts to the medium that is lower than the reference voltage VH, the i-th energy storing command signal IGti falls down. Because the medium level is still higher than the reference level VL, the output signal w of the i-th lower side comparator 122*i* maintains H level. When the level of the consolidated signal IGi shifts from the maximum to the medium, the output signal of the i-th NAND circuit 126*i* becomes H, so that the energy discharging period command signal IGw becomes H. Thereafter, as soon as the consolidated signal IGi falls down to the minimum level that is lower than the reference level VL, the output signal of the i-th lower side comparator 122*i* becomes L, as a result, the energy discharging period command signal IGw falls down.

A multi-spark ignition system according to the fifth embodiment of the invention will be described with reference to FIGS. 17 and 18.

Figure 17:
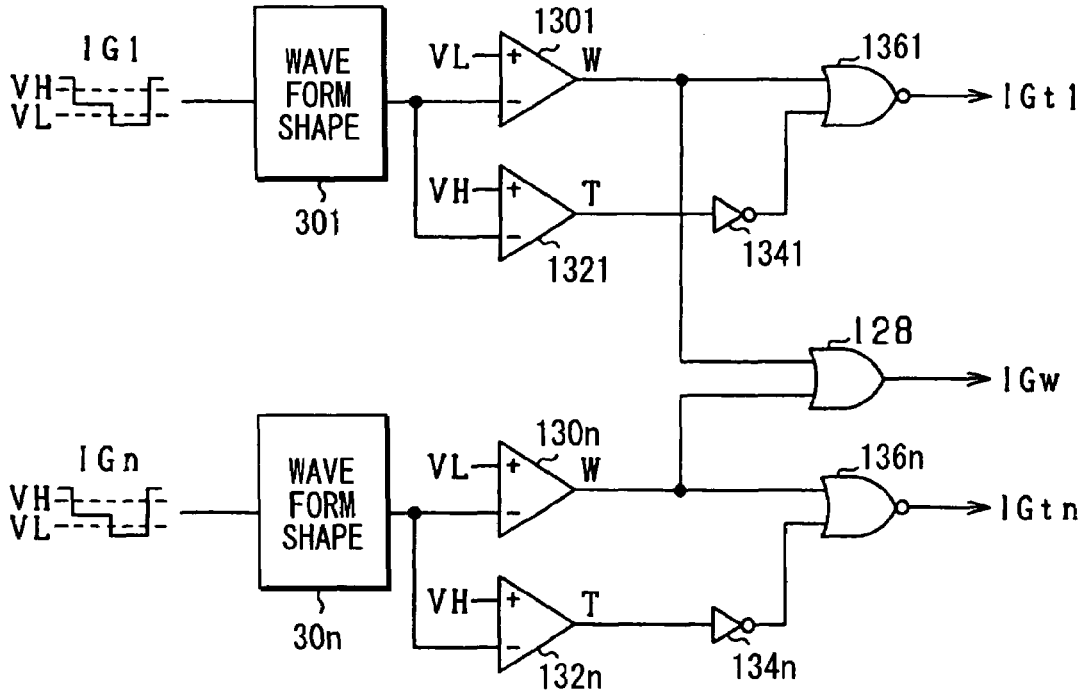
FIG. 17 is a circuit diagram of a separation circuit of the multi-spark ignition system according to the fifth embodiment of the invention.

As shown in FIG. 17, the separation circuit 22 of the fifth embodiment includes wave-form shaping circuits 301-30*n*, lower side comparators 1301-130*n*, higher side comparators 1321-132*n*, inverters 1341-134*n*, NAND circuits 1361-136*n*, an OR circuit 128, etc.

Figure 18:
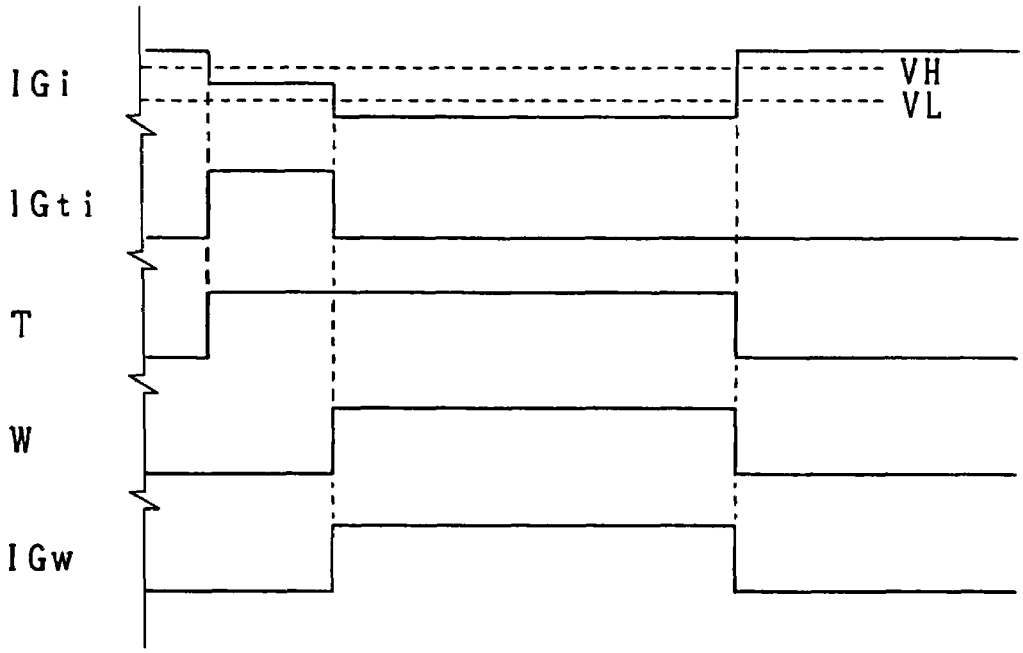
FIG. 18 is a time diagram of generating a energy storing command signal and a energy discharging period command signal of the multi-spark ignition system according to the fifth embodiment of the invention.

As shown in FIG. 18, the consolidated signal has a maximum level, a medium level and a minimum level. The medium level of the consolidated signal includes a signal to store electric energy into the energy storing coil 12. The timing of shifting from the minimum level to the maximum level of the consolidated signal includes a signal to terminate the energy discharging by the i-th spark plug IGPi.

The consolidated signal (e.g. IG1), the wave form of which has been shaped, is inputted to the respective inverting terminals of the comparators (e.g. 1301, 1321). The non-inverting terminal of the lower side comparator (e.g. 1301) is applied a reference voltage VL, and the non-inverting terminal of the higher side comparator (e.g. 1302) is applied a reference voltage VH that is higher than VL. The output signal of the inverter (e.g. 134*i*), which is an inverted signal of the output signal T of the higher side comparator (1321), and the output signal w of the lower side comparator (e.g. 1301) are inputted to the NAND circuit (e.g. 1361) that provides the energy storing command signal (e.g. IGt1).

The OR circuit 128 provides a logical sum of the output signals w of the all the lower side comparator 1301-130*n*. This is the energy discharging period command signal IGw.

As shown in FIG. 18, when the i-th consolidated signal IGi falls down from the maximum to the medium that is higher than the reference level VL, the output signal of the i-th lower side comparator 130*i* maintains the L level. At the same time, the output signal T of the i-th higher side comparator 132*i* becomes H because the medium level is lower than the reference level VH. Accordingly, the inverter 134*i* provides L, so that the energy storing command signal IGti becomes H.

When the level of the consolidated signal IGi shifts to the minimum that is lower than the reference voltage VL, the output signal w of the i-th lower side comparator 130*i* becomes H, so that the i-th energy storing command signal IGti falls down. At the same time, the energy discharging period command signal IGw rises up. When the level of the consolidated signal becomes the maximum, the output signals of the lower side comparator 130*i* and the higher side comparator 132*i* are reversed. As a result, the energy discharging period command signal IGw falls down.

Because the medium level is still higher than the reference level VL, the output signal w of the i-th lower side comparator 122*i* maintains H level. When the level of the consolidated signal IGi shifts from the maximum to the medium, the output signal of the i-th NAND circuit 126*i* becomes H, so that the energy discharging period command signal IGw becomes H. Thereafter, as soon as the consolidated signal IGi falls down to the minimum level that is lower than the reference level VL, the output signal of the i-th lower side comparator 122*i* becomes L. As a result, the energy discharging period command signal IGw falls down.

In the above embodiments, the ignition by the spark plug is initiated in synchronism with the falling edge of the energy discharging period command signal IGw. However, it is possible to initiate the ignition in synchronism with the rising edge of the energy discharging period command signal IGw.

The separation circuit may provide a joint energy storing command signal and a plurality of energy discharging period command signals that respectively corresponds to the plurality of spark plugs.

The above embodiments can be applied to an engine having a single cylinder.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A multi-spark ignition system for an internal combustion engine comprising:

a plurality of ignition coils each of which has a primary coil and a secondary coil;

an energy storing circuit for storing electric energy;

switching means for repeatedly discharging electric energy stored by said energy storing circuit into the primary coil of said ignition coils; and control means for controlling said energy storing circuit and said switching means according to a plurality of consolidated signals each of which includes an energy storing command signal and an energy discharging period command signal.

2. A multi-spark ignition system as in claim 1, wherein said consolidated signal includes a first pulse for setting energy storing timing and a second pulse for setting an energy discharging period.

3. A multi-spark ignition system as in claim 2, wherein said control means makes the duration between the rising edge of the first pulse and the rising edge of the second pulse correspond to the energy storing command signal and the duration between the rising edge of the second pulse and the falling edge of the second pulse correspond to the energy discharging period command signal.

4. A multi-spark ignition system as in claim 3, wherein said control means comprises a latch circuit for latching an inverted signal of the consolidated signal in synchronism with the rising edge thereof to form the energy storing command signal.

5. A multi-spark ignition system as in claim 4, wherein said control means includes a circuit for forming the rising edge of the energy discharging period command signal in synchronism with the falling edge of the energy storing command signal and the falling edge of the energy discharging period command signal in synchronism with the falling edge of the second pulse.

6. A multi-spark ignition system as in claim 2, wherein said control means circuit comprises:

a masking circuit for forming a masking signal that rises up a first preset time after the rising edge of the consolidated signal and falls down a second preset time after the falling edge of the consolidated signal and forming the rising edge of the energy storing command signal from the rising edge of the consolidated signal that is not masked.

7. A multi-spark ignition system as in claim 6, wherein:

said masking circuit comprises a series circuit of a first constant current source and a capacitor, a first switching element connected between the first constant current source and the capacitor, a second constant current source connected between the junction of said first constant current source and said capacitor and a ground, a second switching element connected between said second constant current source and the ground, a comparator for comparing voltage of said capacitor with a reference voltage;

said first switching element has a control terminal to which the consolidated signal is applied; and said second switching element has a control terminal to which the inverted signal of the consolidated signal is applied.

8. A multi-spark ignition system as in claim 2, wherein separation circuit comprises:

a delay circuit for forming a delay signal the rising edge of which delays from the consolidated signal; and a circuit for forming falling edge of the energy discharging period command signal in synchronism with the falling edge of the consolidated signal.

9. A multi-spark ignition system as in claim 8, wherein:

said delay circuit comprises a series circuit of a constant current source and a capacitor and a comparator that compares voltage of the junction of the constant current source and the capacitor with a reference level; and the consolidated signal is applied to said junction.

10. A multi-spark ignition system as in claim 2, wherein the second pulse includes a plurality of pulses each of which is shorter than the first pulse.

11. A multi-spark ignition system as in claim 10, wherein said control means comprises a filtering circuit for removing those of the second pulses that have a shorter pulse width than a preset value and for an energy discharge period command signal forming circuit that forms the falling edge of the energy discharging period command signal in synchronism with the falling edge of the last of the second pulse.

12. A multi-spark ignition system as in claim 11, wherein said filtering circuit comprises a series circuit of a constant current source and a capacitor and a comparator that compares voltage of the junction of the constant current source and the capacitor with a reference level; and the consolidated signal is applied to said junction.

13. A multi-spark ignition system as in claim 11, wherein:

said energy discharge period command signal forming circuit comprises a series circuit of a constant current source and a capacitor and a comparator that compares voltage of the junction of the constant current source and the capacitor with a reference level;

the inverted signal of the consolidated signal is applied to said junction; and the falling edge of the energy discharging period command signal is formed in synchronism with the rising edge of the output signal of said comparator.

14. A multi-spark ignition system as in claim 1, wherein each of the consolidated signals includes three signal levels.

15. A multi-spark ignition system as in claim 14, wherein the three signal levels respectively correspond to the rising edge of the energy storing command signal, the falling edge of the energy storing command signal and the falling edge of the energy discharging period command signal.

16. A multi-spark ignition system as in claim 14, wherein:

said control means further comprises a first comparator that compares the consolidated signal with a first reference level, a second comparator that compares the consolidated signal with a second reference level that is lower than the first reference level, an AND circuit that provides the logical product of the inverted output signal of said first comparator and the output signal of said second comparator; and each of the consolidated signal rises up to the maximum of the signal levels and falls down to the medium of the signal levels and to the minimum of the signal level, in this order.

17. A multi-spark ignition system as in claim 14, wherein:

said control means further comprises a first comparator that compares the consolidated signal with a first reference level, a second comparator that compares the consolidated signal with a second reference level that is higher than the first reference level, an AND circuit that provides the logical product of the output signal of said first comparator and the inverted output signal of said second comparator; and the consolidated signal falls down from the minimum thereof through the medium thereof and rises up to the maximum.

18. A multi-spark ignition system as in claim 1, wherein said control means circuit forms each of the energy storing command signals that corresponds to one of the engine cylinders and a single energy discharging signal based on the consolidated signals.

* * * * *